US011837391B2

(12) United States Patent
Üstüner et al.

(10) Patent No.: US 11,837,391 B2
(45) Date of Patent: Dec. 5, 2023

(54) SINTERED R2M17 MAGNET AND METHOD OF FABRICATING A R2M17 MAGNET

(71) Applicant: Vacuumschmelze GmbH & Co. KG, Hanau (DE)

(72) Inventors: Kaan Üstüner, Gründau-Lieblos (DE); Matthias Katter, Alzenau (DE); Christoph Brombacher, Wiesbaden (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 0 days.

(21) Appl. No.: 17/873,213

(22) Filed: Jul. 26, 2022

(65) Prior Publication Data

US 2022/0406497 A1 Dec. 22, 2022

Related U.S. Application Data

(62) Division of application No. 16/865,982, filed on May 4, 2020, now Pat. No. 11,456,095.

(30) Foreign Application Priority Data

May 21, 2019 (GB) ..... 1907162

(51) Int. Cl.
*H01F 1/055* (2006.01)
*H01F 7/02* (2006.01)
(Continued)

(52) U.S. Cl.
CPC ..... *H01F 1/0557* (2013.01); *H01F 1/0536* (2013.01); *H01F 7/0205* (2013.01); *H01F 41/22* (2013.01)

(58) Field of Classification Search
None
See application file for complete search history.

(56) References Cited

U.S. PATENT DOCUMENTS 4,746,378 A 5/1988 Wysiekierski et al.
2004/0027220 A1 2/2004 Gunther et al.
(Continued)

FOREIGN PATENT DOCUMENTS

CN 1475018 A 2/2004
CN 103779035 A 5/2014
(Continued)

OTHER PUBLICATIONS

Machida, AIP Advances, vol. 7, No. 056223). (Year: 2017).*
(Continued)

*Primary Examiner* — Xiaowei Su
(74) *Attorney, Agent, or Firm* — Dickinson Wright PLLC

(57) ABSTRACT

A sintered $R_2M_{17}$ magnet is provided that comprises at least 70 Vol % of a $Sm_2M_{17}$ phase, wherein R is at least one of the group consisting of Ce, La, Nd, Pr, Sm, Eu, Gd, Tb, Dy, Ho, Er, Tm, Yt, Lu and Y, and M comprises Co, Fe, Cu and Zr. In an area of the $R_2M_{17}$ sintered magnet of 200 by 200 μm viewed in a Kerr micrograph, an areal proportion of demagnetised regions after application of an internal opposing field of 1200 kA/m is less than 5% or less than 2%.

10 Claims, 6 Drawing Sheets

(51) Int. Cl.
*H01F 1/053* (2006.01)
*H01F 41/22* (2006.01)

(56) References Cited

U.S. PATENT DOCUMENTS

| | | | | |
|---|---|---|---|---|
| 2013/0241681 | A1 | 9/2013 | Horiuchi et al. | |
| 2014/0105779 | A1 | 4/2014 | Nakamura | |
| 2015/0348685 | A1 | 12/2015 | Hu et al. | |
| 2016/0293303 | A1 | 10/2016 | Hirota et al. | |
| 2017/0271929 | A1 | 9/2017 | Horiuchi et al. | |
| 2018/0190415 | A1* | 7/2018 | Hagiwara | H02K 7/1823 |
| 2020/0243232 | A1 | 7/2020 | Takezawa et al. | |

FOREIGN PATENT DOCUMENTS

| | | | |
|---|---|---|---|
| CN | 103887028 | A | 6/2014 |
| CN | 107895620 | A | 4/2018 |
| CN | 108352231 | A | 7/2018 |
| EP | 0460528 | A2 | 12/1991 |
| JP | H07138672 | A | 5/1995 |

OTHER PUBLICATIONS

Machida et al., "Magnetic Domain Structures and Magnetic Properties of Lightly Nd-Doped Sm-Co Magnets With High Squareness and High Heat Resistance," IEEE Transactions on Magnetics, 2019, vol. 55, No. 2, 4 pages.
Strnat, "Rare Earth-Cobalt Permanent Magnets," Ferromagnetic Materials, 1988, vol. 4, 79 pages.
Horiuchi et al., "Influence of intermediate-heat treatment on the structure and magnetic properties of iron-rich Sm (CoFeCuZr)Z sintered magnets," Journal of Applied Physics, 2015, vol. 117, 17C704, 5 pages.
Liu et al., "Demagnetization curves and coercivity mechanism in Sm(CoFeCuZr)Z magnets," Journal of Magnetism and Magnetic Materials, 1999, vol. 195, No. 3, 2 pages.

* cited by examiner 25.9%Sm, 21.6%Fe, 5.0Cu, 2.6% Zr

Liquid (As Cast)

PH1 (1155°C)

PH2 (1148°C)

PH3 (1130°C)

SINTERED R2M17 MAGNET AND METHOD OF FABRICATING A R2M17 MAGNET

This U.S. patent application is a divisional of U.S. application Ser. No. 16/865,982, filed May 4, 2020, which claims the benefit of GB Patent Application No. 1907162.0, filed on May 21, 2019, the entire contents of which are incorporated herein by reference for all purposes.

BACKGROUND

1. Technical Field

The invention relates to a sintered $R_2M_{17}$ magnet and a method of fabricating a $R_2M_{17}$ magnet, in particular a sintered $R_2M_{17}$ magnet.

2. Related Art

A $R_2M_{17}$ magnet is an example of a rare earth-cobalt permanent magnetic material which can be referred to as a 2-17 type or $Sm_2Co_{17}$-type magnet. Rare earth-cobalt permanent magnetic materials have a high Curie temperature, for example in the range of 700° C. to 900° C., a high coercive force, for example greater than 20 kOe, and good temperature stability and have found a role in applications such as high performance motors for aircrafts and automobile motor sports. Rare earth-cobalt permanent magnetic materials, such as $R_2(Co, Fe, Cu, Zr)_{17}$, may be fabricated using powder metallurgical techniques to form a sintered magnet. The rare earth-cobalt permanent magnetic material may be fabricated by milling a powder from a cast block, compacting the powder to form a compacted body or green body and heat treating the compacted body to sinter the particles and form a sintered magnet.

The magnetic properties of the sintered magnet have been observed to depend among other parameters on the structure and size of the grains of the sintered magnet [J. Fidler et al. in, Handbook of Magnetism and Advanced Magnetic Materials, Volume 4: Novel Materials, pp. 1945-1968, eds. Kronmüller and S. Parkin, New York: Wiley, 2007EP 3 327 734 A1 discloses a rare earth-cobalt-base composite magnetic material with the aim of improving the mechanical properties.

It is desirable to further improve the magnetic properties of rare earth-cobalt sintered magnets, in particular the remanence and the squareness of the demagnetization curve.

SUMMARY

According to the invention, a $R_2M_{17}$ magnet and methods for fabricating a $R_2M_{17}$ magnet are provided.

The methods for fabricating the $R_2M_{17}$ magnet are based on knowledge of the phase diagram of the 2-17 type rare earth-cobalt alloy. The phase diagram will first be explained with reference to FIG. 1 which, illustrates a schematic view of the phase diagram, in order to ease understanding of the methods described herein.

The 2-17 type rare earth-cobalt alloy described herein is $R_2M_{17}$, wherein R is at least one of the group consisting of Ce, La, Nd, Pr, Sm, Eu, Gd, Tb, Dy, Ho, Er, Tm, Yb, Lu and Y and M comprises Co, Fe, Cu and Zr. In addition to the elements Co, Fe, Cu and Zr, M may optionally comprise further elements such as Ni, Ti and Hf, for example. The $R_2M_{17}$ alloy comprises a phase diagram which includes a portion as illustrated in FIG. 1. Temperature is plotted on the y axis and the rare earth content on the x axis. For the rare earth content indicated with the vertical dashed line in FIG. 1, with decreasing temperature, the phase diagram includes a liquid region, a first phase field PH1, a second phase field PH2 and a third phase field PH3.

The phase diagram comprises a first boundary B1 between the first phase field PH1 and the second phase field PH2 and a second boundary B2 between the second phase field and the third phase field. The first phase field PH1 comprises a liquid phase and at least one solid phase in equilibrium, the at least one solid phase being a 2-17 ($R_2M_{17}$) phase. The second phase field PH2 comprises a solid majority phase with a phase fraction of larger than 95%, the solid majority phase being the 2-17 ($R_2M_{17}$) phase. The third phase field PH3 comprises at least two solid phases of differing composition in equilibrium. The at least two solid phases include the 2-17 ($R_2M_{17}$) phase, a 1-5 phase and a Zr-rich phase. The phase diagram also includes a liquidus line L at temperatures above the first phase field PH1, whereby above the liquidus line L, only liquid phases are present.

The methods of fabricating a $R_2M_{17}$ magnet described herein are based on the concept that during the heat treatment of the compacted $R_2M_{17}$ magnet, in particular, the temperature after the liquid phase sintering heat treatment which is performed in the phase field PH1 should be controlled so that the temperature of the compacted magnet crosses the first boundary B1 between the first and second phase fields PH1 and PH2 and/or the second boundary B2 between the second and third phase fields PH2 and PH3 at least twice.

The temperature at which the boundaries B1 and B2 lie depends on the composition of the 2-17 phase. Therefore, the heat treatment temperatures are defined with reference to the phase diagram so that the methods can be carried out for different compositions. The temperatures at which the phase fields of the phase diagram are found can be determined for a particular composition by preparing samples, heat treating the samples at different temperatures, quenching the samples and examining the microstructures and compositions of the phases in the samples, since each phase field is associated with particular phases which are identifiable by their composition, for example using EDX analysis. Examples are illustrated in FIG. 9.

In a first embodiment of a method of fabricating a $R_2M_{17}$ alloy magnet, wherein R is at least one of the group consisting of Ce, La, Nd, Pr, Sm, Eu, Gd, Tb, Dy, Ho, Er, Tm, Yb, Lu and Y, and M comprises Co, Fe, Cu and Zr, the method comprises:

- heat treating a body comprising a ratio of 2R and 17M, wherein R is at least one of the group consisting of Ce, La, Nd, Pr, Sm, Eu, Gd, Tb, Dy, Ho, Er, Tm, Yt, Lu and Y, and M comprises Co, Fe, Cu and Zr, at a first temperature $T_S$ above the first boundary and in the first phase field, followed by
- cooling the body through the first boundary and optionally heat treating the body at a first temperature $T_H$ that lies between the first boundary and the second boundary, followed by
- heating up the body through the first boundary and heat treating the body at a temperature $T_{AH}$ that lies between the first boundary and the first temperature $T_S$, followed by
- cooling the body through the first boundary and heat treating the body at a temperature below the first boundary.

The body may include compacted powder which may or may not include the 2-17 phase or may be a sintered magnet including the 2-17 phase as a majority phase that is subjected to a further heat treatment to improve the magnetic properties.

The method begins by heating up the body from room temperature to the temperature $T_S$ above the first boundary B1. The temperature $T_S$ lies in the first phase field PH1 and, therefore below the temperature of the liquidus line L for the composition of the body. The temperature $T_S$ is the highest temperature to which the body is subjected. The temperature is then adjusted so that the body is cooled to a temperature such that the body is heat treated within the second phase field PH2 for this composition of the body. The body is then heated up again to a temperature $T_{AH}$ that lies above the first boundary B1 so that the body is heated for a second time at a temperature at which the body is within the first phase field PH1. The temperature $T_{AH}$ of the second heat treatment within the first phase field PH1 is however less than the temperature $T_S$ of the first heat treatment within the first phase field PH1, as $T_{AH}$ is less than $T_S$. The body is then cooled to a temperature below the first boundary B1 so that the body is heat treated at a temperature at which the body lies within the second phase field PH2 for the composition of the body. Optionally, the body is then cooled to a temperature below the second boundary B2 so that the body is heat treated at a temperature at which the body lies within the third phase field PH3 for the composition of the body.

The method of heating the body up through the first boundary followed by cooling the body to a temperature below the first boundary B1 may be repeated a number of times, for example n times, where n is a natural number, before the body is cooled for the first time through the second boundary B2 and is subjected to temperatures lying within the third phase field PH3.

In some embodiments, the method further comprises repeating:

heating up the body through the first boundary and heat treating the body at a temperature $T_{AH}$ between the first boundary and the first temperature $T_S$, followed by cooling the body through the first boundary and heat treating the body at a temperature below the first boundary.

As used herein, heat treating at a temperature is used to mean heat treating at that nominal temperature ±2° C. for a time of at least 15 minutes. In practical terms, this means setting the furnace controller to have a dwell time at the set temperature of at least 15 minutes.

In a second alternative embodiment, a method is provided in which during the sintering heat treatment, the temperature is controlled so that the body crosses the second boundary B2 between the second and third phase fields PH2, PH3 at least twice. In this alternative embodiment, the method comprises:

heat treating a body comprising a ratio of 2R and 17M, wherein R is at least one of the group consisting of Ce, La, Nd, Pr, Sm, Eu, Gd, Tb, Dy, Ho, Er, Tm, Yb, Lu and Y, and M comprises Co, Fe, Cu and Zr, at a first temperature $T_S$ above the first boundary and in the first phase field, followed by cooling the body through the first boundary and optionally heat treating the body at a temperature $T_H$ that lies between the first boundary and the second boundary, followed by cooling the body through the second boundary and heat treating the body at a temperature $T_{BH}$ that lies below the second boundary and above 900° C., followed by heating up the body through the second boundary and heat treating the body at a temperature that lies between the second boundary and the first temperature $T_S$.

The body may be formed from compacted powder and be described as a compacted magnet. The powder and the body formed from the compacted powder may or may not include the 2-17 phase. In some embodiments, the body may be a sintered magnet that includes the 2-17 phase as a majority phase.

The method begins by heating up the body from room temperature to the temperature $T_S$ above the first boundary B1. The temperature $T_S$ lies in the first phase field PH1 and, therefore below the liquidus line L for the selected composition of the body. The temperature $T_S$ is the highest temperature to which the body is subjected. The temperature is then adjusted so that the body is cooled to a temperature such that the body is heat treated at a temperature which lies within in the second phase field PH2 at a temperature $T_H$ and then cooled further to a temperature $T_{BH}$ below the second boundary B2 so that the body is heated within the third phase field PH3. The lower limit for this temperature $T_{BH}$ may be 900° C. The body is then heated up through the second boundary B2 and heat treated for a second time at a temperature that lies above the second boundary B2 for the selected composition so that the body is heat treated at a temperature within the second phase field PH2 or within the first phase field PH1 depending on the temperature. The temperature of this second heat treatment within the second phase field PH2 or within the first phase field PH1 is, however, less than the initial temperature $T_S$. The body is then cooled to a temperature that lies below the second boundary B2 so that the body is heat treated at a temperature that lies in the third phase field PH3 for a second time.

The method of cooling the body through the second boundary B2 followed by heating up the body to a temperature above the second boundary B2 may be repeated a number of times, for example n times, where n is a natural number.

In some embodiments, the method further comprises repeating cooling the body through the second boundary and heat treating the body at a temperature $T_{BH}$ below the second boundary and above 900° C., followed by heating up the body through the second boundary and heat treating the body at a temperature between the second boundary and the first temperature $T_S$.

In the methods described herein, a heat treatment at a temperature is understood to include a dwell time at this temperature of at least 15 minutes. In some embodiments, a heat treatment dwell time at at least one of the temperatures $T_S$, $T_H$, $T_{AH}$ and $T_{BH}$ lies in the range of 30 min to 4 h.

The method of any of the embodiments described herein may further comprise a final heat treatment at a temperature $T_{Hf}$ that is below the first boundary B1 and above the second boundary B2, i.e. within the second phase field PH2. This final heat treatment at the temperature $T_{Hf}$ comprises a dwell time at $T_H$ of 2 to 16 h.

A cooling rate or a heating rate from one heat treatment step to the next heat treatment step of 0.2 K/min to 5 K/min may be used. For example, the cooling rate from the temperature $T_S$ to $T_H$ and the heating rate used from the temperature $T_H$ to $T_{AH}$ may lie in the range of 0.2 K/min to 5 K/min. The cooling rate from the temperature $T_{AH}$ to a temperature below the first boundary B1 may also lie in the range of 0.2 K/min to 5 K/min. In another example, the cooling rate from the temperature $T_S$ to $T_H$ and/or $T_{BH}$ and the heating rate from the temperature $T_{BH}$ to above the second boundary B2 may lie in the range of 0.2 K/min to 5 K/min.

In some embodiments, the method further comprises cooling the body through the second boundary to a temperature of less than 950° C. or less than 900° C. at a cooling rate of greater than 10K/min.

After carrying out a heat treatment according to any one of the embodiments described above, the method may further comprise:

heat treating the body at a temperature of 800° C. to 950° C., or 800° C. to 900° C., for 2 hours to 60 hours, or 8 hours to 48 hours, followed by cooling to 500° C. or 400° C. at a cooling rate of less than 2K/min and heat treating at 300° C. to 500° C. for 0.5 hours to 6 hours.

This heat treatment at temperatures of less than 900° C. is used as a last stage in the heat treatment process and is carried out only once. The heat treatment at temperatures of less than 900° C. may be used to form a nanoscale microstructure which is necessary to obtain high coercivity.

In some embodiments, the difference between the first temperature $T_S$ and the subsequent temperature $T_H$, that is carried out first in the method, is 5° C. to 40° C., or 10° C. to 40° C., i.e. $T_H$ is 5° C. to 40° C. less than $T_S$, or $T_H$ is 10° C. to 40° C. less than $T_S$.

After the heat treatment at $T_S$ and after reheating up the body through the first boundary for the first time, the first temperature used for the heat treatment at a temperature between the first boundary B1 and $T_S$ is denoted $T_{AH}$. Each reheating of the body though the first boundary B1 followed by cooling the body through the first boundary B1 may be denoted as a cycle. This cycle can be repeated a number of times, whereby the temperature used for the heat treatment at a temperature between the first boundary B1 and $T_S$ may be the same or may differ for subsequent cycles.

Subsequent temperatures that lie in the range between the first boundary B1 and $T_S$ are denoted $T_{AHn}$, where n indicates the number of the cycle, may be different from $T_{AH}$. In some embodiments, the body is heated up through the first boundary B1 for a second time and heat treated at a temperature $T_{AH1}$, whereby $T_{AH1}<T_S$, followed by cooling through the first boundary and heat treating at a temperature $T_{H1}$ between the first boundary and the second boundary. In some embodiments, $T_{AH}\geq T_{AH1}$. In some embodiments, $T_{H1}\geq T_H$ and in the next subsequent cycle $T_{AH2}<T_{AH1}$ and $T_{H1}\geq T_{H2}\geq T_H$.

The temperatures may be selected as follows: $T_S$ may lie in the range of 1155° C. to 1210° C., or 1155° C. to 1195° C., $T_H$ may lie in the range of 1120° C. to 1170° C., or 1120° C. to 1160° C., $T_{AH}$ may lie in the range of 1135° C. to 1200° C., or 1135° C. to 1190° C., and $T_{H1}$ may lie in the range of 1125° C. to 1170° C. or 1125° C. to 1160° C.

In some embodiments, R is Sm. In some embodiments, R comprises Sm and at least one of the elements of the group consisting of Ce, La, Nd, Pr, Eu, Gd, Tb, Dy, Ho, Er, Tm, Yt, Lu and Y.

In some embodiments, in addition to Co, Fe, Cu and Zr, M further comprises at least one of the group consisting of Ni, Hf and Ti. In some embodiments, the $R_2M_{17}$ alloy and the body comprises 0 wt %≤Hf≤3 wt %, 0 wt %≤Ti≤3 wt %, 0 wt %≤Ni≤10 wt %.

In some embodiments, the $R_2M_{17}$ alloy and the body comprises 23 wt % to 27 wt % Sm, 14 wt % to 25 wt % Fe, 39 wt % to 57 wt % Co, 4 wt % to 6 wt % Cu, 2 wt % to 3 wt % Zr, maximum 0.06 wt % C, maximum 0.4 wt % O and maximum 0.06 wt % N.

In some embodiments, the powder which is compacted to form the body comprises 23 wt % to 27 wt % Sm, 14 wt % to 25 wt % Fe, 39 wt % to 57 wt % Co, 4 wt % to 6 wt % Cu, 2 wt % to 3 wt % Zr, maximum 0.06 wt % C, maximum 0.4 wt % O and maximum 0.06 wt % N.

In some embodiments, the powder has an average particle size D50 of 4 μm to 8 μm and the sintered magnet has an average grain size of at least 50 μm. An average particle size D50 of 4 μm to 8 μm may be used to assist increasing the density of the compacted body and the sintered magnet. An average grain size of at least 50 μm in the sintered magnet may assist in improving the magnetic properties.

According to the invention, a sintered $R_2M_{17}$ magnet is provided that comprises at least 70 Vol % of a $R_2M_{17}$ phase, wherein R is at least one of the group consisting of Ce, La, Nd, Pr, Sm, Eu, Gd, Tb, Dy, Ho, Er, Tm, Yt, Lu and Y, and M comprises Co, Fe, Cu and Zr. In an area of the $R_2M_{17}$ sintered magnet of 200 μm by 200 μm viewed in a Kerr micrograph, an areal proportion of demagnetised regions after application of an internal opposing field of 1200 kA/m is less than 5% or less than 2%.

The sintered $R_2M_{17}$ magnet includes a low quantity of demagnetized regions after application of an internal opposing field of 1200 kA/m. This small areal proportion of demagnetised regions is thought to be an indication of the improved magnetic properties and directly related to the disclosed annealing treatment.

This areal proportion of less than 5% or less than 2% demagnetised regions in an area of the $R_2M_{17}$ sintered magnet of 200 μm by 200 μm viewed in a Kerr micrograph after application of an internal opposing field of 1200 kA/m has been found to be smaller than that achievable using a single step sintering heat treatment or a stepped sintering heat treatment with a single additional dwell at a temperature between the highest sintering temperature and the homogenisation temperature.

In some embodiments, the sintered $R_2M_{17}$ magnet has an average grain size of >50 μm. The average grain size may be measured from a polished cross-section of a sample according to the standard ASTM E 112.

In some embodiments, the sintered $R_2M_{17}$ magnet further comprises a squareness of the demagnetization curve of at least 85%. The squareness is defined as the ratio of the internal demagnetizing field which is required to irreversibly demagnetize the magnet by 10% and the coercive field strength $H_{cJ}$. A better squareness leads to lower demagnetization losses for magnets with the same coercivity.

In some embodiments, the sintered $R_2M_{17}$ magnet further comprises a coercive field strength $H_{cB}$ of greater than 840 kA/m or greater than 860 kA/m and/or an energy density $(BH)_{max}$ of at least 240 kJ/m$^3$ and/or irreversible losses of less than 10% or less than 5% after subjection to an inner opposing magnetic field of 1200 kA/m and/or a reversible permeability of less than 1.10 or 1.08. Such magnets allow the design of more powerful machines at the same size.

In some embodiments, R is Sm. In some embodiments, R comprises Sm and at least one of the elements of the group consisting of Ce, La, Nd, Pr, Eu, Gd, Tb, Dy, Ho, Er, Tm, Yt, Lu and Y.

In some embodiments, in addition to Co, Fe, Cu and Zr, M further comprises at least one of the group consisting of Ni, Hf and Ti. In some embodiments, 0 wt %≤Hf≤3 wt %, 0 wt %≤Ti≤3 wt % and 0 wt %≤Ni≤10 wt %.

In some embodiments, the sintered $R_2M_{17}$ magnet comprises 23 wt % to 27 wt % Sm, 14 wt % to 25 wt % Fe, 39 wt % to 57 wt % Co, 4 wt % to 6 wt % Cu, 2 wt % to 3 wt % Zr.

In some embodiments, the sintered $R_2M_{17}$ magnet comprises 23 wt % to 27 wt % Sm, 14 wt % to 25 wt % Fe, 39 wt % to 57 wt % Co, 4 wt % to 6 wt % Cu, 2 wt % to 3 wt % Zr, maximum 0.06 wt % C, maximum 0.4 wt % O and maximum 0.06 wt % N.

BRIEF DESCRIPTION OF THE DRAWINGS

Embodiments and examples will now be described with reference to the drawings.

DETAILED DESCRIPTION OF EXAMPLE EMBODIMENTS

Figure 1:
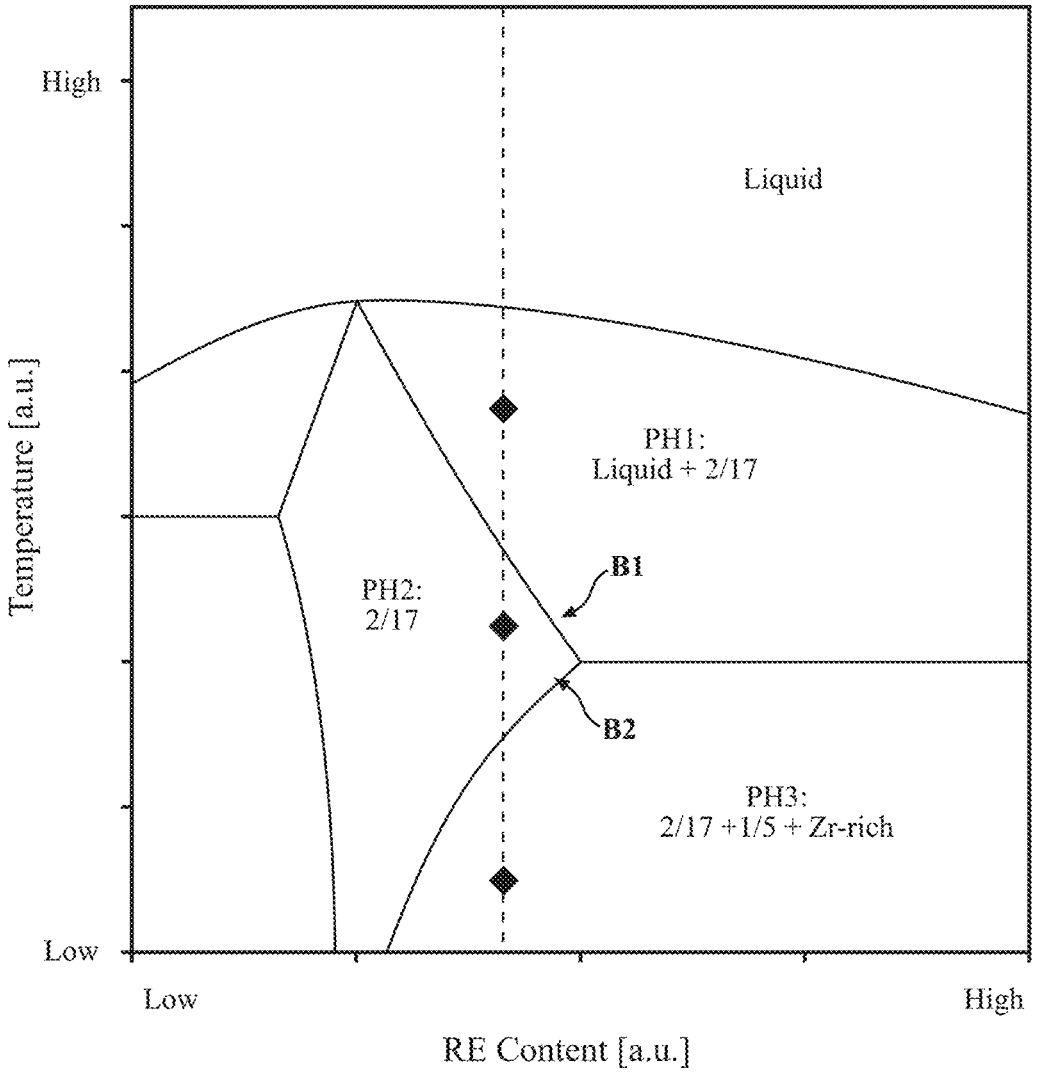
FIG. 1 illustrates a schematic view of a phase diagram of a $R_2M_{17}$ magnetic alloy.

FIG. 1 illustrates a schematic phase diagram of a $R_2(M_{17}$ magnetic alloy and is discussed in detail above. As discussed above, the present invention is based upon the concept of using an alternating or repeating cycle in the sintering heat treatment whereby one or both of the first boundary B1 between the first phase field PH1 and the second phase field PH2 and the second boundary B2 between the second phase field PH2 and the third phase field PH3 is crossed at least twice. The boundary is crossed by cooling the body through the boundary and heating up the body through the boundary after carrying out an initial sintering treatment at a temperature $T_S$. The temperature $T_S$ is the highest temperature to which the body is subjected.

The magnet may be fabricated by first forming a body which may be formed by compacting a precursor powder comprising 2R and 17M, wherein R is at least one of the group consisting of Ce, La, Nd, Pr, Sm, Eu, Gd, Tb, Dy, Ho, Er, Tm, Yt, Lu and Y, and M comprises Co, Fe, Cu and Zr.

In some embodiments, R is Sm only. In some embodiments, R comprises Sm and at least one of the elements of the group consisting of Ce, La, Nd, Pr, Gd, Tb, Dy, Ho, Er, Tm, Yt, Lu and Y.

In some embodiments, in addition to Co, Fe, Cu and Zr, M further comprises at least one of the group consisting of Ni, Hf and Ti. In some embodiments, 0 wt %≤Hf≤3 wt %, 0 wt %≤Ti≤3 wt % and 0 wt %≤Ni≤10 wt %.

This precursor powder and the compacted body does not include the $R_2M_{17}$ phase. In other embodiments, the body which is subjected to the heat treatment of the methods described herein may already include the $R_2M_{17}$ phase and may have already been subjected to a sintering heat treatment.

Figure 2:
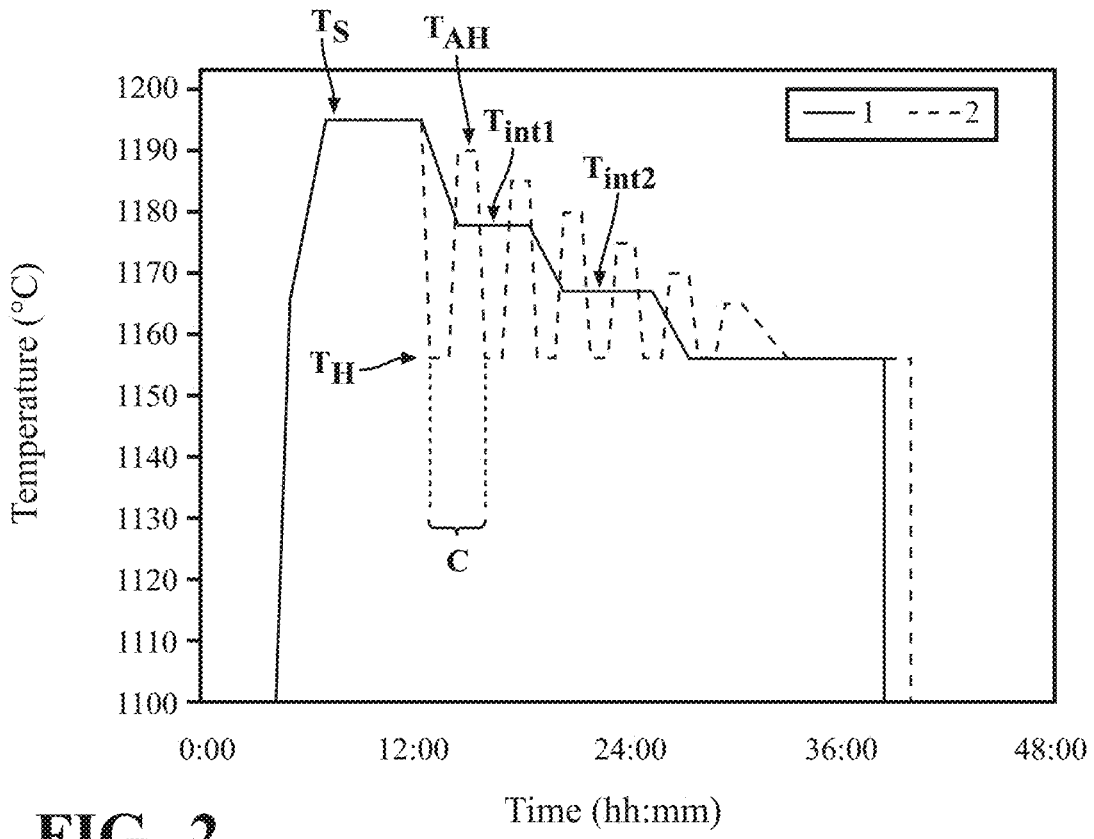
FIG. 2 illustrates a graph of temperature against time and heat treatments according to the invention and a comparison heat treatment.

FIG. 2 illustrates a graph of temperature as a function of time and illustrates example 2 that represents a heat treatment according to the invention and a comparison heat treatment 1.

In all embodiments, the body is heated up from room temperature to a first temperature $T_S$ which is selected to lie above the first boundary B1 and within the first phase field PH1 for that composition. The sintering heat treatment is indicated in FIG. 2 with the reference $T_S$. The temperature $T_S$ is held for a dwell time $t_S$ which may lie in the range of 0.5 to 4 hours.

In comparison example 1, the body is then slowly cooled from the temperature $T_S$ to a first intermediate temperature $T_{int1}$, then to a second intermediate temperature $T_{int2}$ and then cooled to a temperature $T_H$. $T_{int1}$ and $T_{int2}$ lie between $T_S$ and $T_H$.

In some embodiments according to the invention, such as example 2 illustrated in FIG. 2, the temperature is then reduced to temperature $T_H$ which is selected such the body is heat treated at a temperature $T_H$ within the second phase field PH2 so that the temperature has been reduced through the temperature at which the first boundary B1 between the first and second phase fields PH1, PH2 is positioned for this particular composition of the body. The temperature $T_H$ is indicated in FIG. 2 and the temperature may be held at the temperature $T_H$ for a time $t_H$ in the range of 0.5 to 4 hours.

In example 2, the body is then heated up again from the temperature $T_H$ to a temperature $T_{AH}$ which is selected to be above the first boundary B1 and below the first temperature $T_S$. The temperature can be maintained at the temperature $T_{AH}$ for a dwell time $t_{AH}$ in the range of 0.5 to 4 hours. The body is then cooled again to a temperature below the first boundary B1.

This heating up of the body through a temperature corresponding to the first boundary B1 and cooling the sample again to a temperature below the first boundary B1 and in the second phase field PH2 may be described as a cycle, indicated in FIG. 2 with C. This cycle C may be repeated a number of times before cooling the body through the second boundary B2 and down to a temperature below the second boundary B2 and above 900° C.

In some embodiments, the temperature $T_{AH}$, which is above the first boundary B1 and below sintering temperature $T_S$ may be incrementally reduced for each subsequent repetition of the cycle. In some embodiments, the temperature $T_H$ within the second phase field, that is used for subsequent cycles may be substantially the same. In some embodiments, the temperature $T_{AH}$ which lies between the first boundary B1 and the sintering temperature $T_S$ may be reduced in each subsequent repetition of the cycle, but not necessarily monotonically, and the temperature $T_H$ used to heat treat the body within the second phase field may be increased in subsequent repetitions of the cycle.

The use of such a method is found to improve the magnetic properties of the final product, that is the sintered magnet, and to improve the magnetic properties in a reliable fashion. In some embodiments, the magnetic properties of a coercive field strength $H_{cB}$ of greater than 840 kA/m, an energy density $(BH)_{max}$ of at least 240 kJ/m$^3$, irreversible losses of less than 10% after subjection to an inner opposing magnetic field of 1200 kA/m and a reversible permeability of less than 1.10 or 1.08 are achieved.

Figure 3:
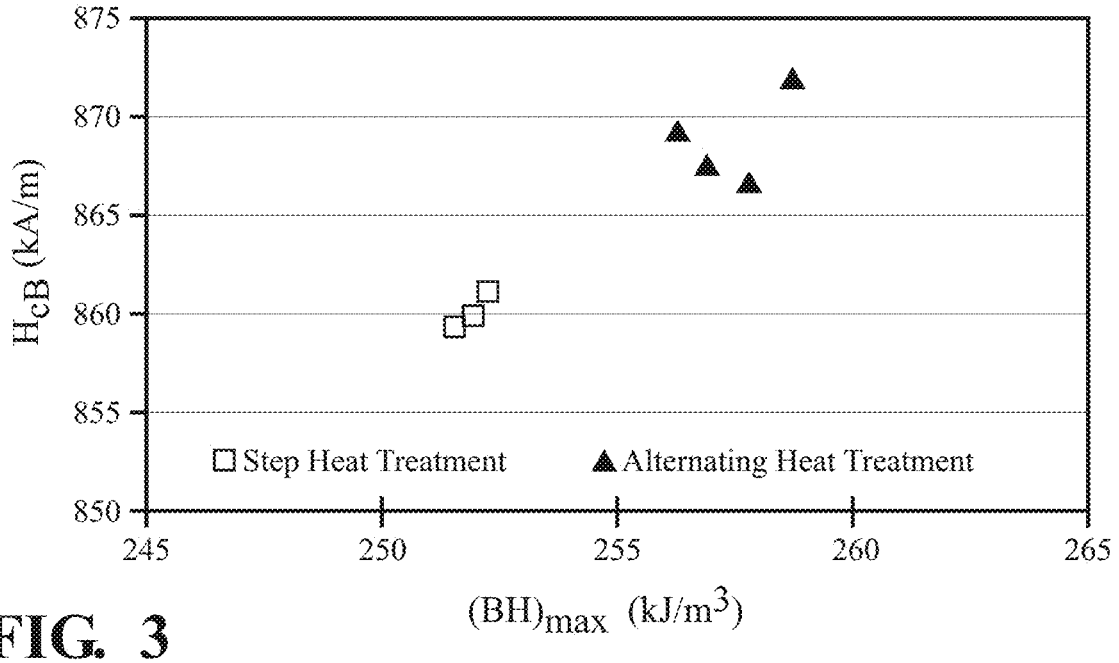
FIG. 3 illustrates a graph of magnetic properties of sintered magnets according to the invention and comparison sintered magnets.

FIG. 3 illustrates a graph of $H_{cB}$ (kA/m) against $(BH)_{Max}$ (kJ/m$^3$). Samples heated according to the invention and corresponding to heat treatment 2 in FIG. 2, are indicated with the triangles. Samples heat treated according to example 1 in FIG. 2 are indicated with squares. FIG. 3 illustrates that the values of $H_{c3}$ and $(BH)_{Max}$ are increased for the samples according to the invention.

One explanation for the improvement observed is that in order to achieve a high energy density and coercive field strength, it is necessary to provide a sintered magnet with a high density, a relatively large grain size and a composition and crystal structure that is not only similar for each of the grains but that is also similar and uniform at the nanoscale within the grains.

The features of a high density, large grain size and uniform composition can be achieved if the sinter temperature is sufficiently high, since a high sinter temperature leads to a larger grain size and a high remanence and as a consequence a high energy density.

The sintering temperature $T_S$ is higher than the homogenisation temperature $T_H$ so that a portion of the magnetic material is liquid, since the sintering temperature $T_S$ lies within the first phase field PH1. In the first phase field PH1, the body includes a liquid phase and a solid phase, which is the 2-17 ($R_2M_{17}$) phase, which have different compositions. The use of higher temperatures leads to an increase in the size of the grains. However, the distance between the phases of different composition, that is the liquid phase and the 2-17 phase, is increased. During cooling down the magnet from sintering temperature to homogenization temperature the liquid phase crystallizes into 2-17 phase with a different composition compared to the portion which is already solid during the sintering treatment. As a result, there are regions close to the grain boundaries which have a significantly different composition compared to the regions near the center of the grains. As the distance between these regions of different composition increases with increasing grain size, the composition cannot be homogenized sufficiently during the single step homogenization treatment. As a result, the magnetic properties achievable and in particular the coercive field strength of the different regions and the squareness of the demagnetisation curve, are reduced.

According to the invention, this reduction in the magnetic properties achievable as a result of the increasing distance between the regions of different composition is mitigated or avoided by providing a composition and crystal structure that is not only similar for each of the grains but that is also similar and uniform at the nanoscale within the grains. It seems that the repeated crossing of the phase borders B1 and/or B2 leads to an unexpected increase of the diffusion activity of the various elements. This increased diffusion activity in turn results in a better homogeneity within the final grains despite the large grain size. Finally, the better homogeneity leads to a more uniform coercivity in the final magnet which results in the better overall magnetic properties.

In order to achieve a composition and crystal structure that is similar and uniform at the nanoscale within the grains, according to the invention, a homogenisation treatment is carried out at the temperature $T_H$ within the second phase field PH2 before the distance between the different phases present in the first phase field PH1 exceeds a predetermined limit. Therefore, the dwell time at $T_S$ and $T_{AH}$ is restricted. The aim of the homogenisation treatment is to form a composition in each grain that is uniform, metastable and homogenous, whereby the composition of the 2-17 phase is as similar as possible over the volume of the grain. The homogenisation temperature $T_H$ may be around 5° C. to 30° C. lower than the temperature by which all of the liquid phases have solidified, therefore, the homogenisation temperature $T_H$ may be around 5° C. to 30° C. below the first boundary B1.

In the solid state, that is at temperatures within the second phase field PH2, the diffusion paths are relatively long and longer than the typical average grain size, which is at least 10 μm so that long heat treatment times would, in principle, be required to form the 2-17 phase from the different phases formed during the heat treatment in the first phase filed PH1. Furthermore, if compositions are selected with a higher iron content, for example greater than 15 weight percent iron, in order to achieve a higher remanence and energy density, the homogenisation temperature decreases with increasing iron content which further increases the heat treatment time. Therefore, the invention is particularly beneficial for compositions with an iron content of greater than 15 weight percent.

The present invention is based on the concept that despite the long diffusion paths and low homogenisation temperatures present at temperatures within the second phase field PH2, a fast diffusion into a uniform state can be realised and the volume of the phases that arise during sintering at temperatures above B1 can be reduced by carrying out the repetition of the cycle C of the heat treatment temperature at $T_{AH}$ in the first phase field PH1 but below the sintering temperature followed by a heat treatment at $T_H$ in the second phase field PH2. An improved uniformity and homogeneity within the grains can be achieved in a short time with this method as is demonstrated by the results of FIG. 4.

It is thought that this observation can be explained by two mechanisms. Firstly, diffusion in the liquid phase is faster than in the solid phase. Therefore, it is useful to not cross the temperature range between the sintering temperature, $T_S$ and $T_{AH}$, which lies within the first phase field PH1, at which there is a larger percentage of the liquid phase but different local compositions, and the homogenisation temperature, $T_H$, which lies in the second phase field PH2, in which there is no liquid phase but only a single phase with a homogenous composition in thermal equilibrium, too quickly, in order to use the advantages of the fast diffusion in the liquid phase more efficiently. Secondly, the repetition of solidification and melting is used in the methods described herein to accelerate the diffusion in the region of the boundaries between the phases, similar to an increased diffusion speed along the grain boundaries in the solid state. Both of these mechanisms are used together in the methods described herein in order that a large grained, single phase metastable structure with uniform composition within the grains can be produced in a relatively short time.

This state, i.e. large grained, single phase metastable structure with uniform composition, can be effectively frozen in the body by using a fast cooling step. A subsequent hardening annealing step at a relatively low temperature can be used in order to transform the metastable phase into three different phases having a suitable arrangement in space. Finally, a relatively slow cooling can be used during which the composition of the individual phases is optimised by diffusion over the phase boundaries, whereby the spatial arrangement of the phases is not significantly altered.

Sintered magnets heat treated using the methods described herein were discovered to have a characteristic magnetic property which can be determined using the Magneto-optic Kerr effect (MOKE).

The samples for the Kerr examinations were ground and polished and afterwards magnetised using a magnetic field around 7 T and then partially demagnetised by applying opposing magnetic field pulses of around 800 kA/m. Due to the shape of the sample this results in an internal demagnetizing field strength of about 1200 kA/m. In the Kerr micrographs illustrated in FIGS. 4 and 5 the easy axis of the magnetisation is essentially orthogonal to the polished surface and therefore orthogonal to the plane of the micrograph. The dark regions are regions in which the north pole, which was the original magnetisation direction, points out of the plane of the micrograph. The light regions are those which are demagnetised as a result of the opposing magnetic field and the internal demagnetising field.

Figure 4:
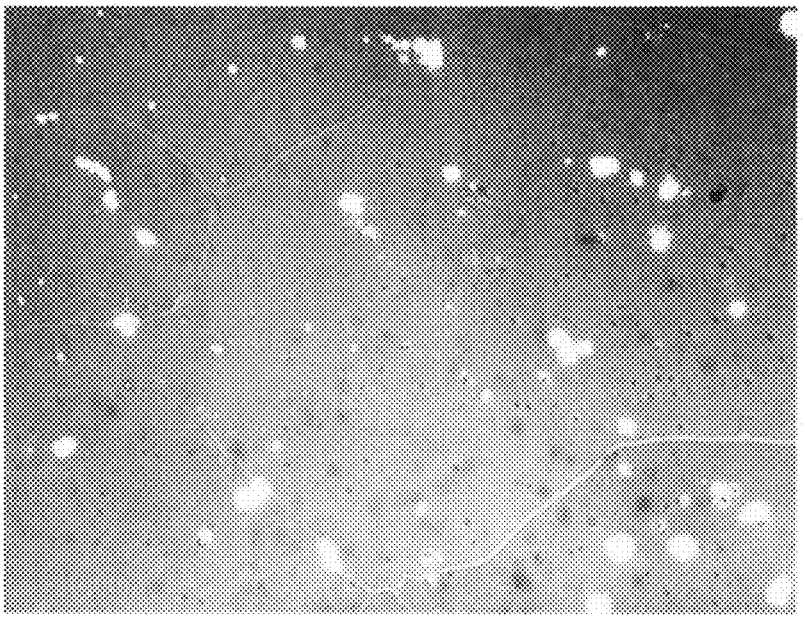
FIG. 4 illustrates a Kerr micrograph of a sample from a sintered magnet according the invention.

FIG. 4 illustrates a MOKE image of a sample fabricated using the heat treatment described herein after application of an external opposing field pulse of 800 kA/m in which only thin lines (bright to grey contrast) along the grain boundaries are demagnetized. These demagnetized grain boundary regions are the reason why it is beneficial to have a large grain size since then the volume fraction of the grain boundary region decreases. The few very bright spherical regions within the grains are related to impurity phases like oxides which are not magnetic at all.

Figure 5:
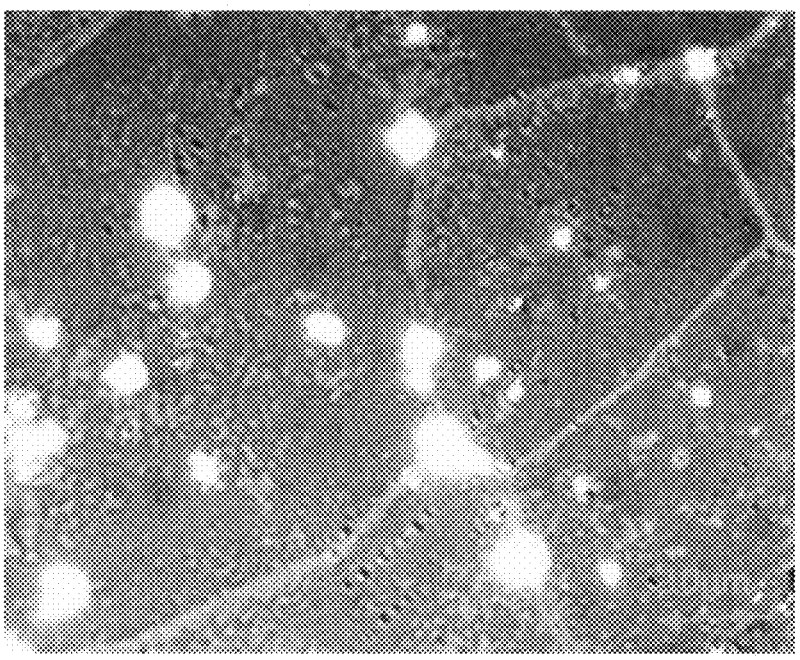
FIG. 5 illustrates a Kerr micrograph of a sample from a comparison sintered magnet

FIG. 5 illustrated a MOKE image of a comparison sample which was subjected to the same opposing external magnetic field of 800 kA/m. In contrast to the sample according to the invention illustrated in FIG. 4, there are lots of lighter grey regions in both the centre and along the grain boundary region of the grains which are already demagnetised, see FIG. 5. The spherical very bright dots are once again non-magnetic impurity phases.

Comparison of these micrographs also shows that the demagnetisation of the comparison sample of FIG. 5 is more inhomogeneous than that of the sample according to the invention. The improved uniformity of the samples according to the invention is surprising in view of the much larger grain size which would be expected to hinder the uniformity of the composition and structure as discussed above.

Figure 6:
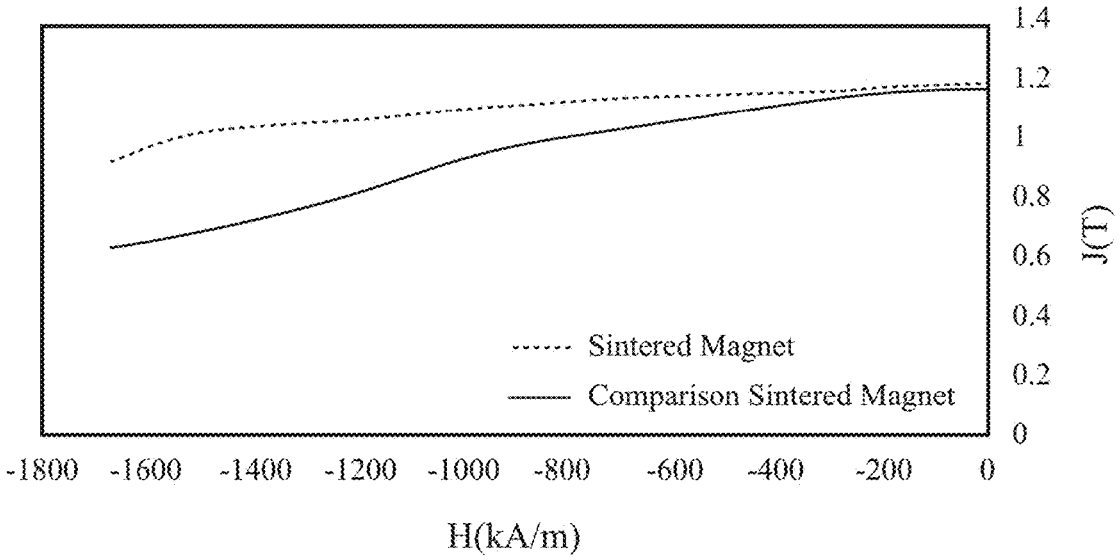
FIG. 6 illustrates a graph of J(T) against H(kA/m).

As shown in FIG. 6, this difference in the MOKE images can be seen in the difference between the squareness of the demagnetisation curve. The squareness is defined as the ratio of the internal demagnetising field which is required to irreversibly demagnetise the magnet by 10%, and the coercive field strength $H_{CJ}$. The squareness of the demagnetisation curve for a comparison sample is less than around 0.7. In contrast, the sample heat treated according to the invention has a squareness of greater than 0.85.

Figure 7:
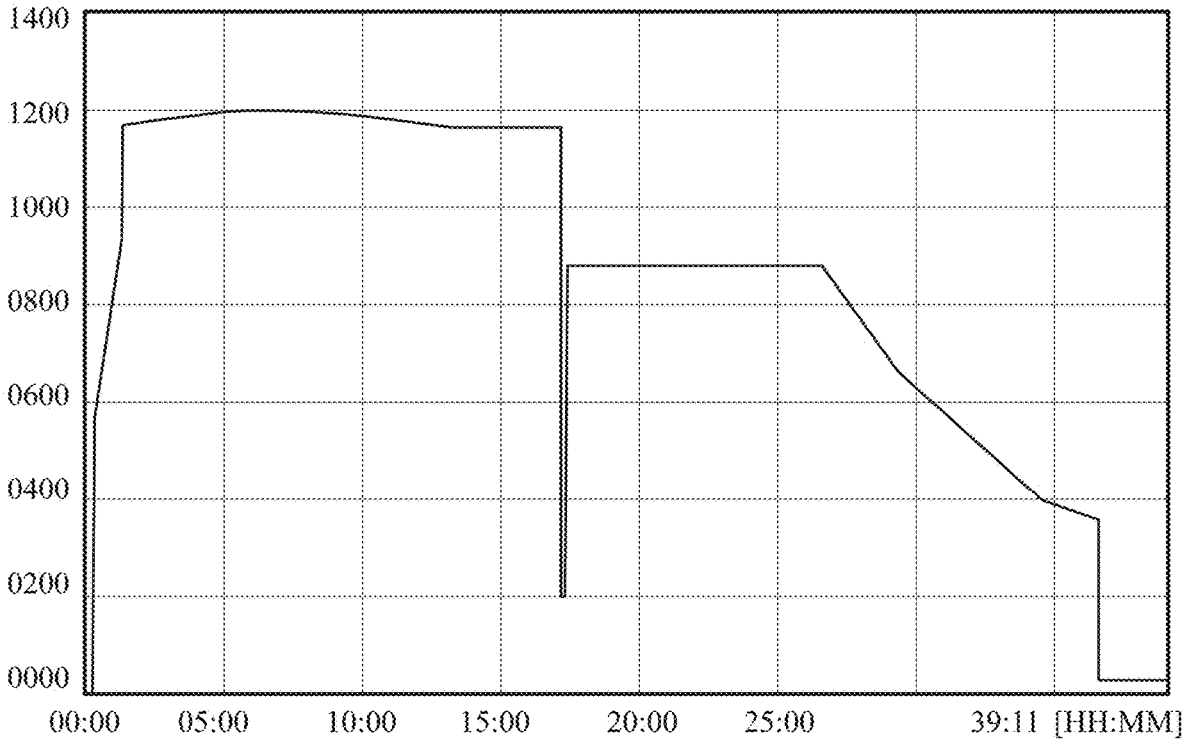
FIG. 7 illustrates the heat treatment used to fabricate the sample of FIG. 5.

The comparison sample of FIG. 5 was heat treated using the treatment shown in FIG. 7 which includes a sinter treatment followed by a single homogenisation treatment and followed by an annealing treatment.

Figure 8:
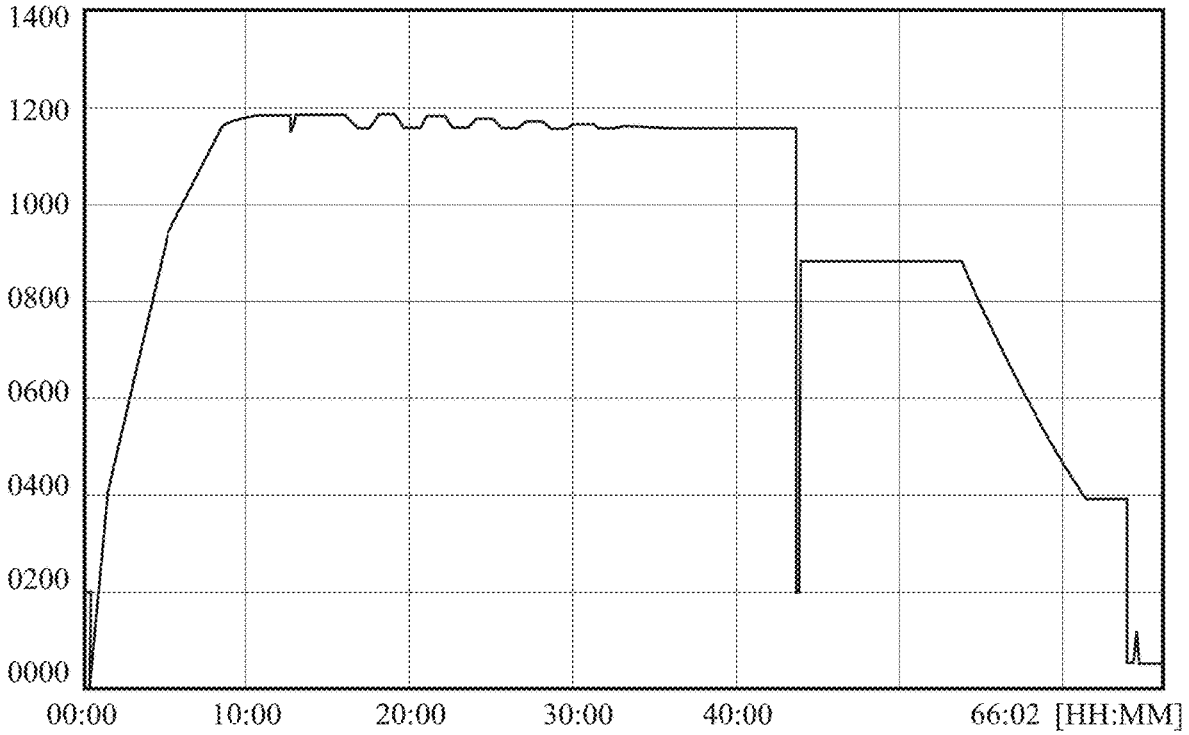
FIG. 8 illustrates the heat treatment used to fabricate the sample of FIG. 4.

The sample according to the invention of FIG. 4 was heat treated using the treatment illustrated in FIG. 8. An alternating heat treatment was carried out and the sample subjected to multiple heat treatments in the first phase field PH1 and the second phase field PH2 before cooling to a temperature of less than 900° C., performing an annealing treatment below 900° C. and finally cooling down to room temperature.

The temperatures at which the phase fields of the phase diagram are found can be determined for a particular composition by preparing samples, heat treating the samples at different temperatures, quenching the samples and examining the microstructures and compositions of the phases in the samples, since each phase field is associated with particular phases which are identifiable by their composition, for example using EDX analysis.

Figure 9:
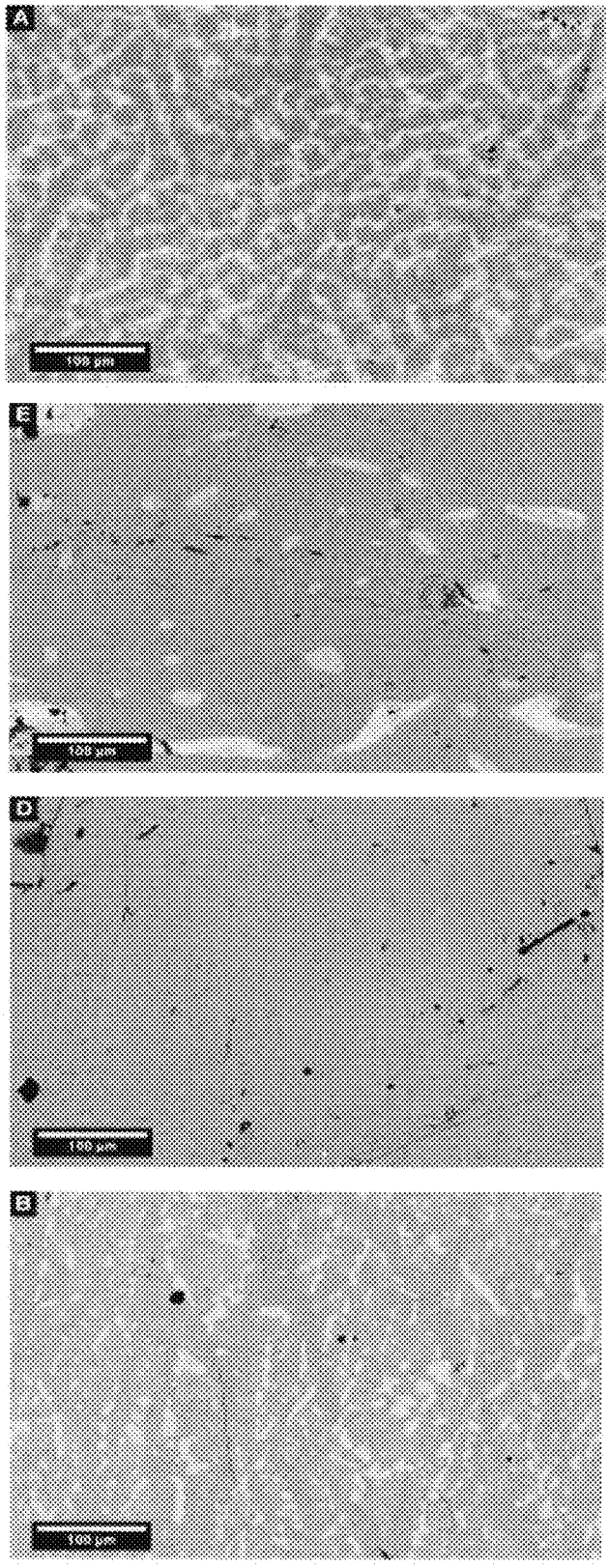
FIG. 9 illustrates SEM micrographs of sample quenched from temperatures at different positions in the phase diagram.

FIG. 9 illustrates SEM micrographs of polished cross-sections of samples of a sintered $R_2(Co, Fe, Cu, Zr)_{17}$ material that were heat treated at a temperature within the liquid region, the first phase field PH1, the second phase field PH2 and the third phase field PH3, respectively, and quenched from these temperatures. The microstructure and phases present in the sample at the respective temperature can be seen.

The samples illustrated in FIG. 9 had a composition of 25.9 wt % Sm, 21.6 wt % Fe, 5.0 wt % Cu, 2.6 wt % Zr, balance Co. The temperatures of 1155° C. for the first phase field PH1, 1148° C. for the second phase field PH2 and 1130° C. for the third phase field PH3 given in FIG. 9 are the temperatures at which the samples were heat treated and lie within the indicated phase field for this composition.

The sample heat treated at a temperature above the liquidus has an ill-defined structure. The sample heat treated at a temperature within the first phase field PH1 comprises a liquid phase and at least one solid phase in equilibrium, the at least one solid phase being a 2-17 phase. The sample heat treated at a temperature within the second phase field PH2 comprises a solid majority phase with a phase fraction of larger than 95%, the solid majority phase being the 2-17 phase. The sample heat treated at a temperature within the third phase field PH3 comprises at least two solid phases of differing composition in equilibrium. The at least two solid phases include the 2-17 phase, a 1-5 phase and a Zr-rich phase.

Thus, the temperature at which the boundaries B1 and B2 lie for a selected composition of the 2-17 phase can be determined using this method so that temperatures can be selected for a particular composition that lie within the phase fields recited herein.

The invention claimed is:

1. A sintered $R_2M_{17}$ magnet, comprising: at least 70 vol % of a $R_2M_{17}$ phase, wherein R is at least one selected from the group consisting of Ce, La, Nd, Pr, Sm, Eu, Gd, Tb, Dy, Ho, Er, Tm, Yt, Lu and Y, and M comprises Co, Fe, Cu and Zr, wherein, in an area of the $R_2M_{17}$ sintered magnet of ≥200 by 200 μm viewed in a Kerr micrograph, an areal proportion of demagnetised regions after application of an internal opposing field of 1200 kA/m is less than 5%.

2. The sintered $R_2M_{17}$ magnet of claim 1, further comprising an average grain size of >50 μm.

3. The sintered $R_2M_{17}$ magnet of claim 1, further comprising a coercive field strength HcB of greater than 840 kA/m.

4. The sintered $R_2M_{17}$ magnet of claim 1, further comprising a reversible permeability of less than 1.10.

5. The sintered $R_2M_{17}$ magnet of claim 1, wherein M further comprises at least one selected from the group consisting of Ni, Hf and Ti.

6. The sintered $R_2M_{17}$ magnet according to claim 5, wherein 0 wt %≤Hf≤3 wt %, 0 wt %≤Ti≤3 wt % and 0 wt %≤Ni≤10 wt %.

7. The sintered $R_2M_{17}$ magnet of claim 1, wherein the sintered $R_2M_{17}$ magnet comprises 23 wt % to 27 wt % Sm, 14 wt % to 25 wt % Fe, 39 wt % to 57 wt % Co, 4 wt % to 6 wt % Cu, 2 wt % to 3 wt % Zr, maximum 0.06 wt % C, maximum 0.4 wt % O and maximum 0.06 wt % N.

8. The sintered $R_2M_{17}$ magnet of claim 1, wherein, in the area of the $R_2M_{17}$ sintered magnet of ≥200 by 200 μm viewed in the Kerr micrograph, the areal proportion of demagnetised regions after application of the internal opposing field of 1200 kA/m is less than 2%.

9. The sintered $R_2M_{17}$ magnet of claim 3, wherein the coercive field strength HcB is greater than 860 kA/m.

10. The sintered $R_2M_{17}$ magnet of claim 1, further comprising a reversible permeability of less than 1.08.

* * * * *